United States Patent [19]

Dischinger

[11] 4,234,111

[45] Nov. 18, 1980

[54] DEVICE FOR THREADING STRINGS OR THE LIKE

[76] Inventor: Gebhard Dischinger, Josefstrasse 33, 7710 Donaueschingen, Fed. Rep. of Germany

[21] Appl. No.: 928,912

[22] Filed: Jul. 28, 1978

[30] Foreign Application Priority Data

Jul. 30, 1977 [DE] Fed. Rep. of Germany ..... 2734441

[51] Int. Cl.[2] ..... D05B 85/00

[52] U.S. Cl. ..... 223/104; 273/73 A; 112/80; 29/241

[58] Field of Search ..... 223/104, 102, 103; 112/80, 169; 273/73 A; 29/241, 433

[56] References Cited

U.S. PATENT DOCUMENTS

| | | | |
|---|---|---|---|
| 1,671,957 | 5/1928 | Kottle | 112/80 |
| 3,740,825 | 6/1973 | Buyken et al. | 29/241 X |

*Primary Examiner*—Peter P. Nerbun

*Attorney, Agent, or Firm*—Irvin A. Lavine

[57] ABSTRACT

A device for threading strings or the like through bores of an anchoring part consisting of a tube detachably secured to a handle with a stylus extending from the handle and being received within the tube. The free tip of the stylus projects beyond the forward end of the tube. The device is inserted within the bore, the handle and stylus are subsequently withdrawn, and the tube remains in the bore. A thread is then inserted in the tube. This is followed by removal of the tube leaving the string threaded within the bore.

19 Claims, 14 Drawing Figures

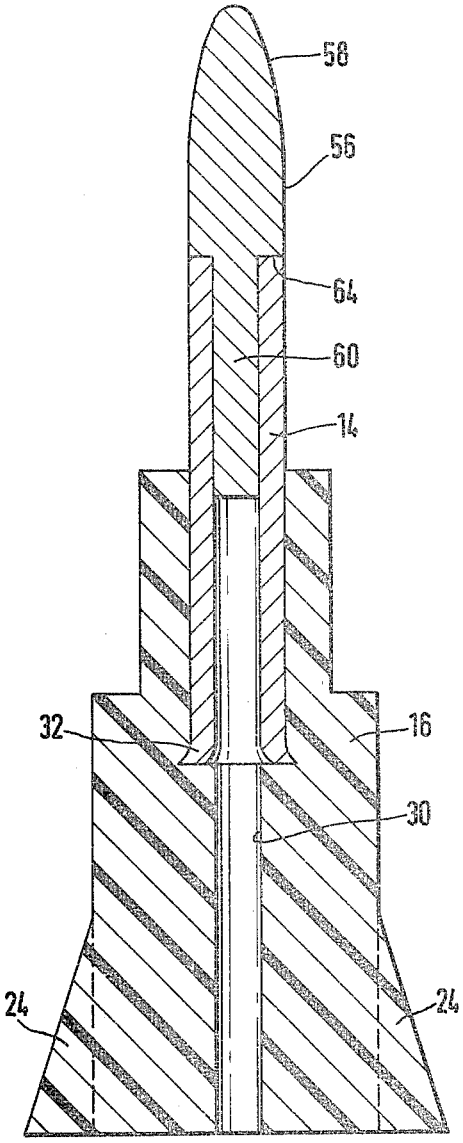
FIG. 7
FIG. 8
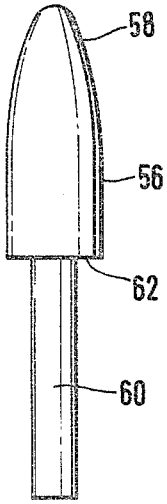

DEVICE FOR THREADING STRINGS OR THE LIKE

The invention relates to a device for threading strings or the like in a through bore in an anchoring part, frame, or the like. The term anchoring part is used quite generally for any part into whose bore a string, thread, or the like is to be inserted. An anchoring part of this type can be for example, a frame or a racket for tennis, badminton, squash, and the like or can also be a portion of human tissue. The tool according to the invention can be used, however, in all cases when string or thread-like structures must be pulled into through bores in frame or strip-like structures, for example in the manufacture of sieves or other reticulated grids.

When inserting strings or the like, for example when stringing rackets of the type described hereinabove with plastic or gut strings, it is always difficult to thread additional strings in holes, for example in the racket frame, which are already traversed by one or more strings. Usually the remaining space in the hole is enlarged with an awl to admit another string. This squeezes the strings already in the hole, and there is also the danger that the strings will be damaged by the tip of the tool, and this is particularly dangerous in the case of gut strings. Even after a hole has been enlarged in this manner, with the application of a certain amount of force, the strings can often be pulled through only with great difficulty and with considerable expenditure of time.

On the other hand, it is also known to use a needle with an eye, to pull a new string through. This means that a double thickness of string must be forced through the narrow opening in the vicinity of the eye, which is especially disadvantageous. This method, too, is cumbersome and time-consuming, and in particular, because of the force which must be employed, it is often impossible to prevent damage to the strings already in the hole. Damaging the strings shortens the life of the entire grid, whose construction is rather expensive.

The goal of the invention is to provide a device which allows easy and rapid threading of strings or the like, even in very narrow holes, without damaging strings or the like already in the hole.

This goal is achieved according to the invention by a handle, a tube connected to the handle, the inside diameter of said tube matching the outside diameter of the string to be inserted with some play, and by a stylet with a tapered, rounded tip, insertable in the tube in such manner that it partially fills the tube and partially projects from the forward end of said tube.

The tip of the device, consisting of the projecting tube and the stylet projecting beyond said tube, is introduced into the hole from one side, whereupon the stylet is removed at least from that part of the tube which is in the hole, so that an empty section of the tube remains in the hole. The end of a string or the like can then be threaded into the tube and pushed into it from the opposite side of the hole. Then the tube with the string inside is slipped out of the hole and pulled off the string. As soon as the tube has been pulled off the string by means of the part of the device which is connected to said tube, the string passes through the hole in the desired manner. After the stylet and tube have been reassembled, the next threading process can begin. Since the projecting part of the stylet is tapered and rounded at the tip and completely fills the cross section of the tube with the part which extends into said tube, said tube being preferably made completely with thin walls, this tip of the device can be introduced very carefully into the hole without damaging the strings already located therein. It should be pointed out in this connection that the use of the device according to the invention does not require permanent dilation of the empty space between strings already in the hole, as is required when an awl is used, to allow the string to be introduced after the awl has been withdrawn. On the contrary, the tip of the device according to the invention can be inserted as carefully and precisely as possible into the hole and the string inserted into the tube, while the latter is in the hole. Not only does this considerably facilitate and accelerate the stringing process, but also ensures considerable protection for the strings already in the hole.

In a simple embodiment, the tube can be firmly attached to the handle, and the stylet in this case can be inserted into the tube from the free end of the latter. After being inserted in the hole, only the stylet need be withdrawn from the free end of the tube and the string inserted in the tube. After the tube is withdrawn, the string will have been threaded through the hole.

In an advantageous embodiment of the invention, the tube is disposed in a through bore in an inserting part and projects from the forward end of the latter. The inserting part is extractably connected to the handle, but is nonrotatable with respect to the extraction direction. In this embodiment, after the tube and the stylet projecting from the latter have been inserted in the hole, the handle and stylet are removed from the inserting part, so that only the inserting part with the tube remains in the hole. In this embodiment, the string can be pushed all the way through the tube and through the connecting through axial bore in the inserting part, so that it can be grasped and pulled further through at the other end of the bore. It is only at this point that the inserting part together with the tube is withdrawn, sliding on the string out of the hole, and is pulled off the string. To prepare for the next threading process, the handle, stylet, and tube need only be reassembled. f In another advantageous embodiment of the invention, the stylet is firmly attached to the handle and passes through the entire axial bore of the inserting part, including the tube, in the assembled state. As soon as the tip of the device has been inserted in the hole, only the inserting part needs to be pulled out of the handle, whereby the stylet is simultaneously also pulled partially out of the inserting part.

In another advantageous embodiment of the invention, the inserting part is completely separable by pulling it out of the handle. This has the advantage that only a single part of the inserting part needs to be pulled off in order to free the tube for stringing. Furthermore, the handle together with the stylet can be pulled off on the same side from which the tip of the device is inserted. This has the further advantage that with the exception of the actual threading of the string, it is necessary to work only on the outside of the frame or the like, which is free of the strings that have already been installed and of tools for preliminary holding and tensioning of the strings, such as clamps, inverters and the like. The relatively thin-walled tube is reinforced by the stylet which rests against its interior.

In order to be able to rapidly exchange the relatively long and thin stylet if it should be damaged, it is also proposed according to the invention to make the stylet interchangeably threadable in the handle.

In order to reduce further the possible danger of damage to the strings already in a hole when inserting the tip of the device in this embodiment, in an advantageous embodiment of the invention the leading edge of the tube, which is already thin-walled, can be further rounded on the outside so that it makes a smooth transition with the projecting stylet and presents no edge.

In an advantageous embodiment of the device according to the invention, the stylet comprises a shaft insertable in the forward end of the tube, said shaft making a stepwise transition to the tip, whereby the step on the tip abuts the leading edge of the tube in the assembled state and the outer surfaces of the tip and the tube merge smoothly with one another. The stylet in this case, in view of the dimensions of the hole and the tube, is so small that it can be actuated from the inside in practically any case. In this instance, the leading edge of the tube is preferably not rounded or tapered, presenting the broadest possible supporting surface for the tip of the stylet. The shaft of the stylet should extend into the tube at least sufficiently far to provide a reliable support for the stylet on the tube.

In order to support the stylet on the handle side, a pin, corresponding to the diameter of the shaft, can be firmly mounted advantageously in this embodiment to the handle, with the shaft abutting said pin when assembled with the handle, inserting part, and stylet. The stylet and pin together in this embodiment form so to speak an equivalent to the continuous stylet in the embodiment described above. The shaft and pin together thus reinforce the relatively thin-walled tube and reduce the pressure with which the leading edge of the tube presses against the step on the stylet tip.

The pin can also be advantageously interchangeably threaded in the handle, so that it can be easily replaced when damaged.

Since the introduction of the tip of the device into a narrow hole is facilitated by rotating this tip, the handle should be removably but preferably nonrotatably connected to the inserting part, as mentioned above. In another embodiment of the invention, the inserting part is provided on its exterior with axial ribs for this purpose, said ribs being insertable with play in matching axial recesses in the handle.

In another preferred embodiment of the device, the latter is made integral, so that the individual parts cannot be lost. This is achieved by making the inserting part removable from the handle only as far as a stop, whereby the stylet fills no more than a portion of the length of the tube when the inserting part is pulled out to the stop. If the tube itself extends only over a part of the bore of the inserting part, the stylet will also be incapable of fitting into the tube in the withdrawn state. Hence, that part of the length of the tube which is not filled by the stylet when the inserting part is in the withdrawn position, said length being capable of extending in extreme cases over the entire length of the tube, should be slightly longer than the hole in the anchoring part, frame, or the like which accepts the string. This embodiment not only has the advantage that individual parts of the device cannot be lost, but also that the comfortable handle of the device is available for pulling the tube out of the hole. The relatively delicate tube and the equally delicate stylet are always well protected, since the stylet and tube are always telescoped into one another when the device is not pulled out.

In an advantageous embodiment of the latter design, the inserting part comprises a guide section, said section fitting displaceably in a corresponding recess in the handle in the withdrawal direction of the inserting part. The stop is advantageously formed by a pin which passes through the guide section at right angles to the withdrawal direction and is guided in at least one lengthwise slot, whereby the pin is fastened in the handle and the lengthwise slot is provided in the guide section of the inserting part, or vice versa.

The thin-walled tube of the inserting part is more advantangeously made of metal, preferably steel, and can be cast directly in the inserting part to hold it in place when the inserting part is made of plastic. More advantageously, the stylet and/or pin is made of metal, preferably steel. However, it is also possible in the second embodiment described above, with a separate stylet composed of a tip and shaft, to make the stylet of plastic or another suitable material.

The handle is normally in the form of an elongated part which has a comfortable fit to the hand and extends in the axial direction of the device. If it is necessary in special cases to introduce the device into a frame from below, the handle can be made in the form of a pistol butt in an advantageous improvement to the invention.

Embodiments of the invention are described in greater detail hereinbelow with reference to the drawings.

FIG. 7 is an enlarged axial section through a second embodiment of the inserting part and stylet;

FIG. 8 is a side view of the stylet according to FIG. 7;

Figure 1:
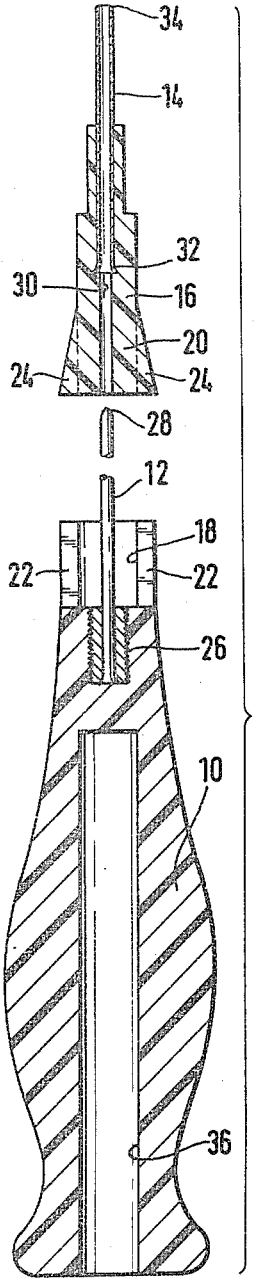
FIG. 1 is an axial section through a first embodiment of the device, whereby the inserting part is pulled off the handle which is firmly connected to the stylet.
Figure 2:
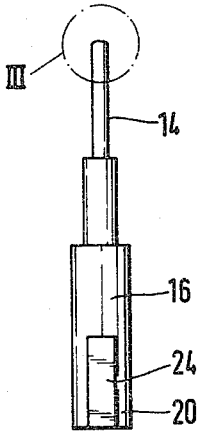
FIG. 2 is a side view of the inserting part, rotated around the lengthwise axis through 90° relative to FIG. 1.

The device shown in FIGS. 1 to 6 comprises a handle 10, said handle being elongated, being comfortable to the hand of the user, and extending in the lengthwise direction of the device, a stylet part 12 consisting of a thin, elongated stylet, and an inserting part 16, containing a thin tube 14. Handle 10 is provided at its forward end with a cylindrical taper 18, into which the rearward end 20 of inserting part 16 is insertable with play. At diametrally opposite points, taper 18 changes into radial slits or recesses 22, serving to accept wedge-shaped radial ribs 24 of inserting part 16. In the assembled state shown in FIG. 4, inserting part 16 is releasably but nonrotatably connected to handle 10.

The handle is provided with a bore 26 with an internal thread as an axial extension of taper 18. An external thread located at the rearward end of stylet 12 is screwed into this inside thread, so that the stylet is firmly connected to handle 10. The tip 28 of stylet 12 is tapered and rounded to avoid damaging the strings when inserted into a hole.

Inserting part 16 comprises a through axial bore 30, into whose forward section tube 14 is firmly inserted, and preferably cast in place. At its rearward end, tube 14 comprises a flare 32 for improved anchoring in inserting part 16.

Figure 4:
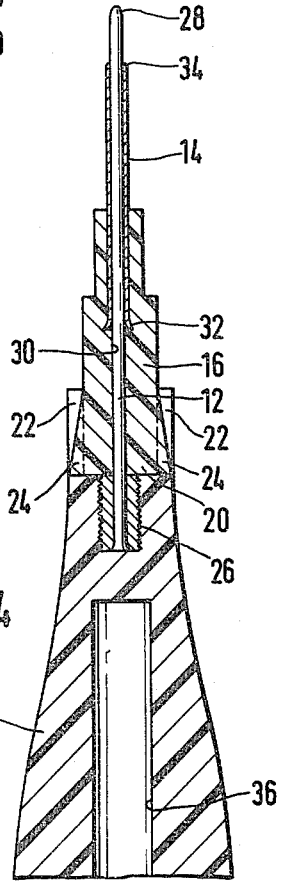
FIG. 4 is a cross section corresponding to FIG. 1, through the device in the assembled state, whereby a portion of the handle is cut away.

In the assembled state shown in FIG. 4, stylet 12 fills tube 14 completely, and extends out of the forward end of the latter with its tip 28.

Figure 3:
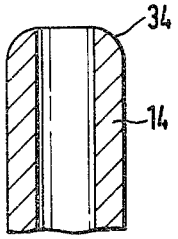
FIG. 3 is an enlarged representation of the tip of the tube which falls within circle III in FIG. 2.

As shown in FIG. 3, the leading edge 34 of thin-walled tube 14 is rounded on the outside in such manner that it makes a flush transition to the projecting stylet 12 and conforms to the latter. This measure also is very useful to prevent damage to the strings.

For reasons relating to injection molding technology, and also to make handle 10 as light as possible, the latter is provided in the embodiment shown with an axial recess 36.

Figure 5:
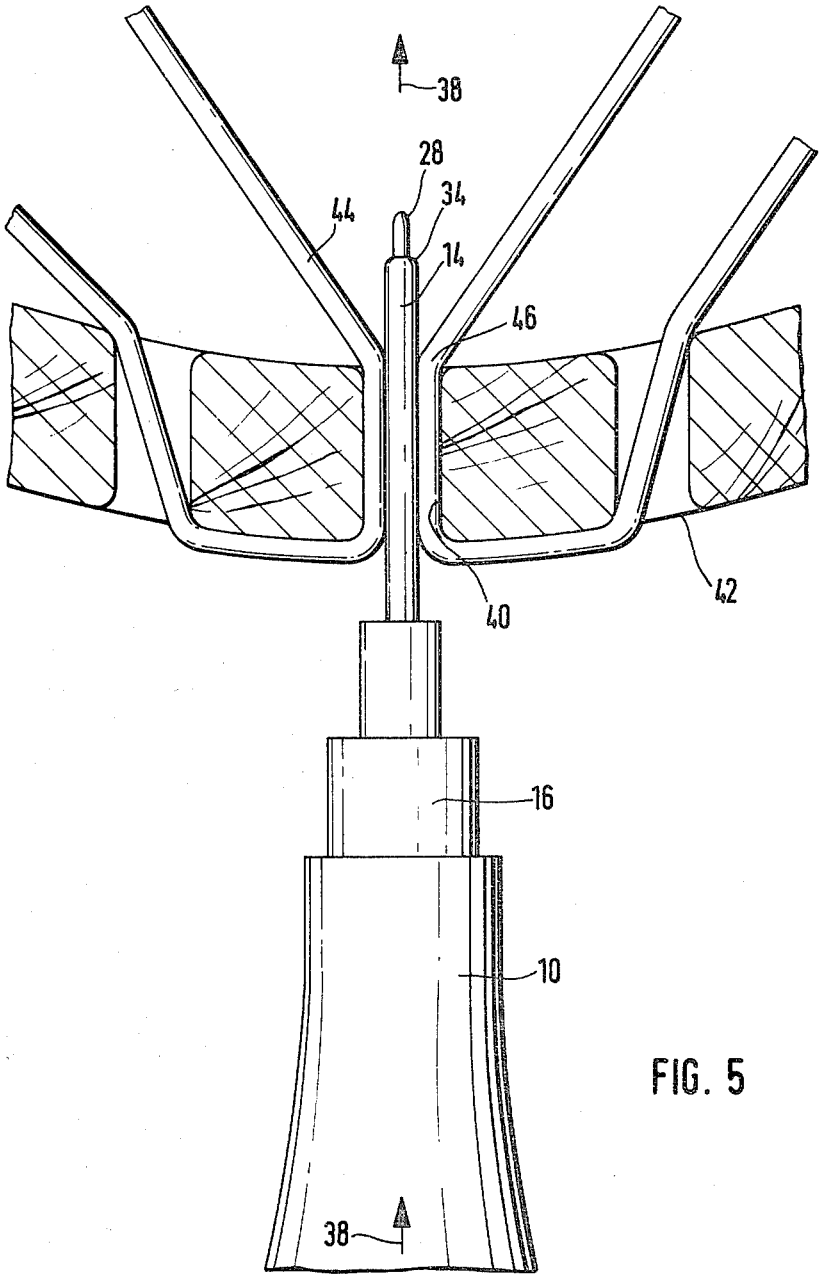
FIG. 5 is an enlarged partial view of the device according to FIGS. 1 to 4 after insertion of the tip in the hole of a tennis racket frame.
Figure 6:
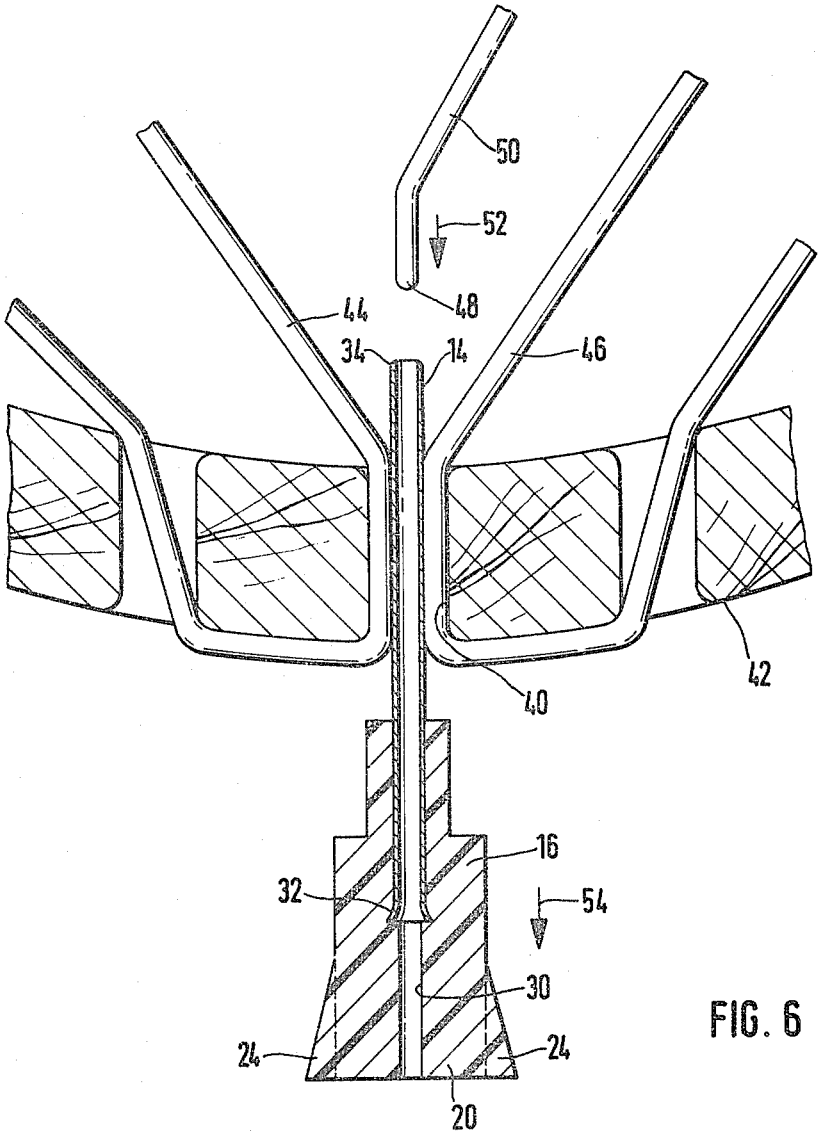
FIG. 6 is an axial section through the inserting part with the tube located in the bore of the frame before a string is threaded through it, and after withdrawal of the handle with the stylet.

As shown in FIG. 5, the tip of the device shown in FIGS. 1 to 4, comprising tube 14 and the section of stylet 12 located inside the tube and projecting out of the latter, is inserted in the direction of arrow 38 in a hole 40 in a tennis racket frame 42, already containing previously inserted strings 44 and 46. Handle 10 together with stylet 12 is then pulled outward and off inserting part 16, leaving tube 14 in hole 40 between strings 44 and 46, already located in the hole. The free end 48 of another string 50 is then inserted in the direction of arrow 52 into the open forward end of tube 14, and pushed through the axial bore of the inserting part until it projects in a manner not shown from the rearward end of the inserting part. Then inserting part 16 together with tube 14 can be pulled away from string 50 in the direction of arrow 54, whereupon the end 48 projecting on the outside of frame 42 is grasped and can be handled further. There is no possibility of damaging the already installed strings 44 and 46 either during the insertion or withdrawal of the tip of the device into or out of hole 40. The process involving threading string 50 into tube 14 and inserting part 16, and the subsequent pulling of the inserting part off the string, proceed extraordinarily rapidly and simply.

Figure 9:
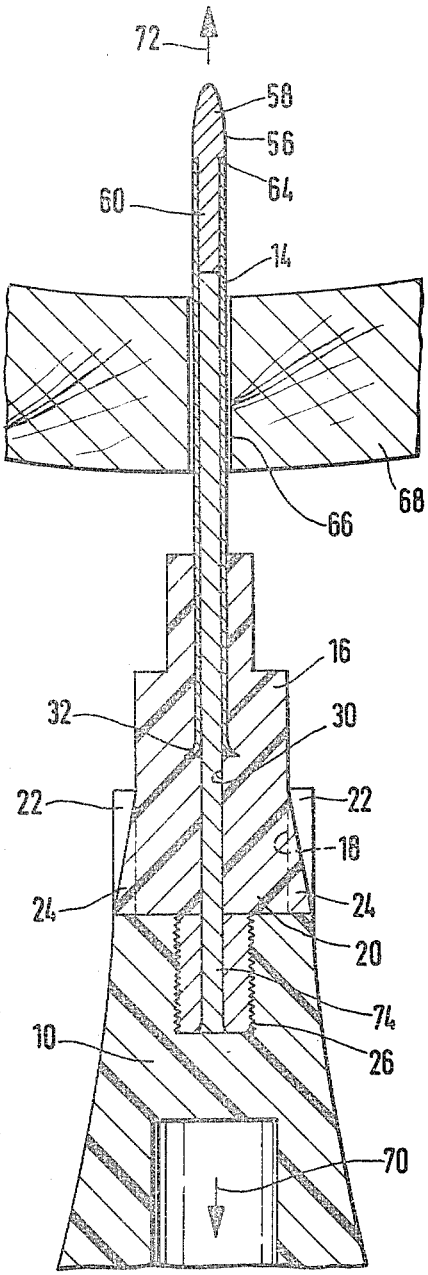
FIG. 9 is an axial section through a device according to the invention with the second embodiment of the inserting part and stylet according to FIGS. 7 and 8, whereby the tip of the device is inserted in the hole of a frame and the handle is shown partially cut away.

In the embodiment shown in FIGS. 7 to 9, a stylet 56 separate from the handle is provided, said stylet consisting of a tip 58, tapered and rounded in the forward section, and a shaft 60, projecting axially rearward. Tip 58 merges with shaft 60 at a radial step 62.

The same reference numbers as above are used for parts of this embodiment which are the same as or correspond to the first embodiment described hereinabove.

The radial thickness of step 62 corresponds to the wall thickness of tube 14, whose leading edge 64 is not rounded in this embodiment. In the assembled state shown in FIG. 7, step 62 abuts the leading edge 64 of the tube and the outer surfaces of tip 58 and tube 14 merge flush with one another. When the tip of the device is inserted in a hole in a frame, damage to strings already in the hole is practically completely obviated.

After the tip of the device comprising stylet 56 and tube 14 has been inserted in the manner shown in FIG. 9 into a hole 66 in a frame 68, whereby none of the strings already located in hole 66 is shown for the sake of simplicity, handle 10 can be pulled off inserting part 16 in the direction of arrow 70 and stylet 56 can be pulled off the forward end of tube 14 in the direction of arrow 72. This leaves the inserting part with tube 14 in bore 66 in the same manner as shown in FIG. 5 for the first embodiment in which it was inserted in hole 40. Then the stringing process can proceed in the manner described. It is necessary merely to reassemble the parts of the device to begin a new stringing process.

In the second embodiment of the apparatus, shown in FIGS. 7–9, the handgrip carries an adjacent pin in combined relationship on the rearward end of the shaft 60 of the mandrel 12 in the first embodiment, by means of an external thread fixed to its rear end, in an inside thread in an axial hole 26 in the handgrip. This pin 74 contributes on the one hand to the stability of the small tube 14 and on the other hand supports the mandrel 56 in axial relationship, so that the applied pressure of the thin front edge 64 of the small tube 14 on the step-like part 62 is lessened.

Figure 10:
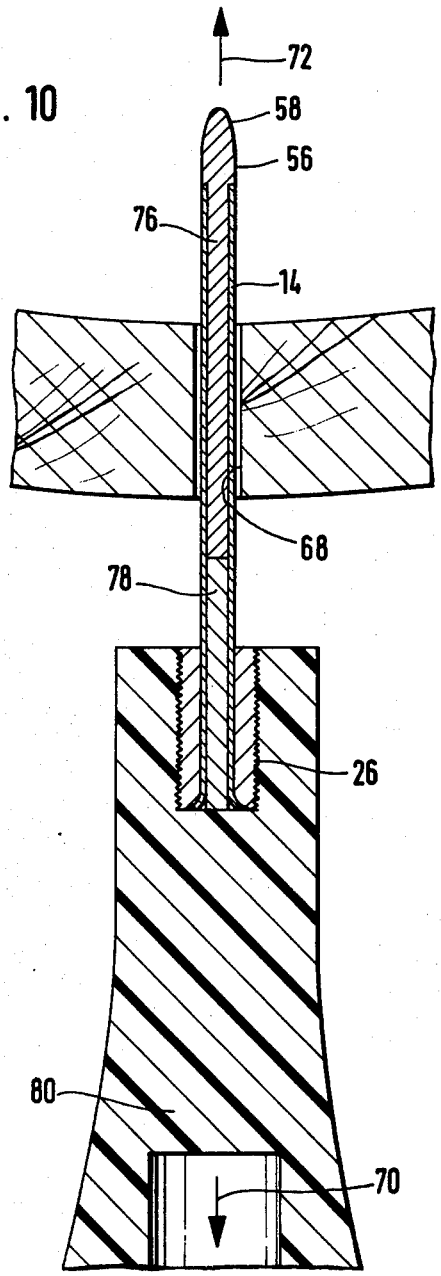
FIG. 10 is an axial section corresponding to FIG. 9, through a third embodiment of the device according to the invention.
Figure 11:
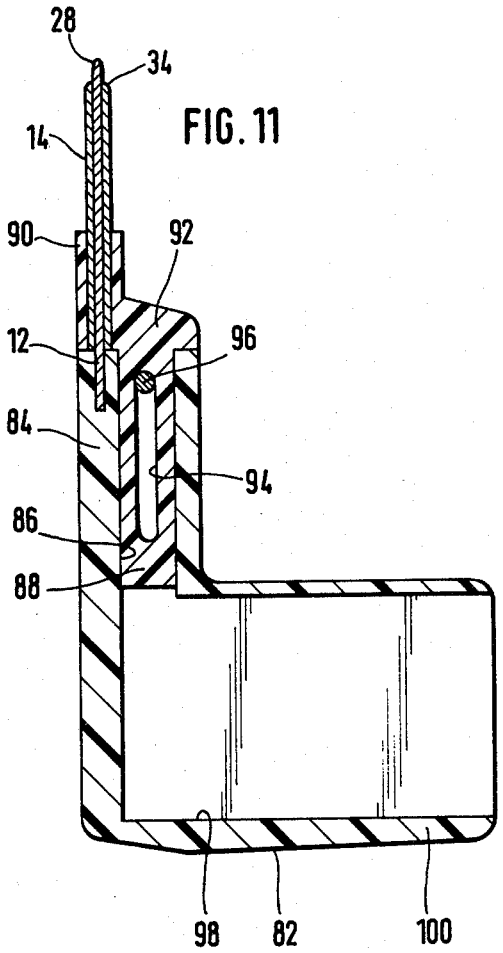
FIG. 11 is a side view of a fourth embodiment of the device according to the invention, with the inserting part in the non-withdrawn state.
Figure 12:
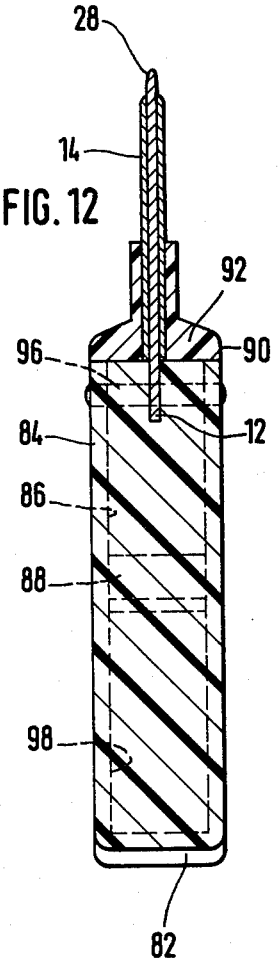
FIG. 12 is a top view of the device shown in FIG. 11.
Figure 13:
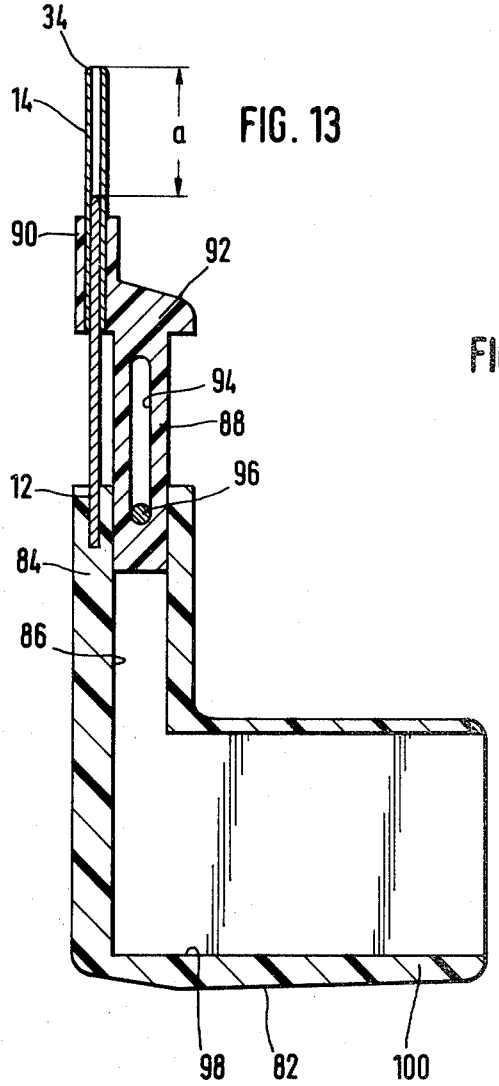
FIG. 13 is a side view corresponding to FIG. 11, of the same embodiment with the inserting part in the withdrawn state.
Figure 14:
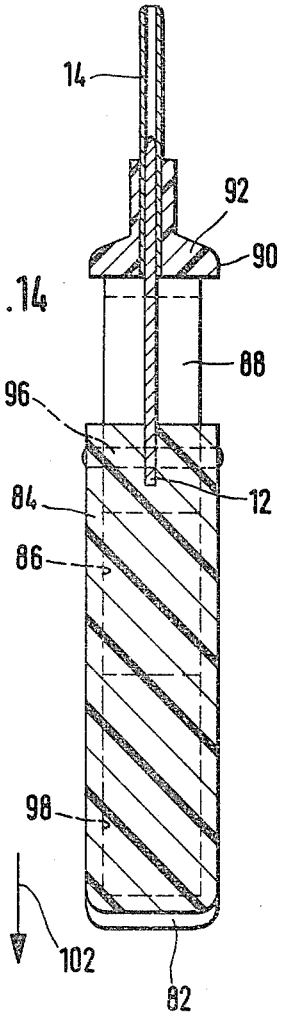
FIG. 14 is a top view of the device shown in FIG. 13.

In the third embodiment of the invention, the same reference numerals are utilized for corresponding parts. This embodiment differs from that represented in FIG. 9 essentially in that the shaft 76 of the mandrel 56 is longer and the pin 78 is shorter. In this simple embodiment, pin 78 and the small tube 14 are solidly connected to each other and by means of an external thread situated on their rearward end, are screwed into an internal thread 26 of a corresponding hole in the handgrip. After the introduction of the tip of the apparatus, composed of mandrel 56 and the small tube 14, in the hole 66, according to FIG. 10, the mandrel 56 moves in accordance with the arrow 72, can be drawn out, following which the cord (not shown) is threaded into the small tube 14, until it encounters pin 78 and then handgrip 80 is pulled in the direction of the arrow 70, whereby the small tube is guided out of the hole 66. The cord is then carried through the hole 66. By merely pushing in the mandrel 56 into the small tube 14 the apparatus is once again ready for use.

In the fourth embodiment of the invention shown in FIGS. 11 to 14, handle 82 is made in the form of a pistol butt. One leg 84 of the handle is provided with a recess 86 running in the lengthwise direction, with a rectangular cross section, in which recess a guide section 88 of the inserting part, generally designated by 90, is retractable with play into the position shown in FIGS. 13 and 14. Inserting part 90 comprises a part 92, wider than the guide section 88 up to the outer dimensions of leg 84, said part 92 fitting flush with leg 84 of the handle in the nonwithdrawn position shown in FIGS. 11 and 12. In this embodiment tube 14 is anchored in the widened part 92, while the stylet 12, displaceable in the tube, is anchored in leg 84 outside recess 86. The length of stylet 12 is set so that it projects outward in the nonwithdrawn position of the inserting part shown in FIGS. 11 and 12, out of the outer end of tube 14, with its tapered and rounded end 28. In this embodiment, too, the outer end of tube 14 has a rounded part 34.

In this embodiment, inserting part 90 is attached to handle 82 so that it cannot be lost. This is accomplished by virtue of the fact that guide section 88 is traversed by a continuous lengthwise slot 94, in which a pin 96 is guided, said pin being anchored near the outer end of leg 84. When inserting part 90 is in the withdrawn position shown in FIGS. 13 and 14, pin 96 together with the rearward end of lengthwise slot 94 forms a stop for the withdrawing movement of the inserting part. In the nonwithdrawn position of inserting part 90 shown in FIGS. 11 and 12, pin 96 abuts the forward end of lengthwise slot 94.

Since handle 82 is preferably injection-molded from plastic, recess 86 advantageously merges with a hollow space 98 in the other leg 100 of the handle, said space running at right angles to said recess, whereby manufacture is simplified and the functioning ability of the handle is not affected disadvantageously. Inserting part 90, manufactured separately, is inserted with its guide section 88 into recess 86, whereupon pin 96 is forced by a press fit into the wall of leg 84, passing through lengthwise slot 94.

In this embodiment of the device, the manner of operation is similar to the embodiments described above. This means that the device, in the nonwithdrawn state shown in FIGS. 11 and 12, together with the tip comprising tube 14 and stylet 28, is initially inserted in the hole. Then handle 82 is pulled back into the withdrawn position shown in FIGS. 13 and 14. Stylet 12 then exposes a length a of tube 14, which passes through the hole, a being sufficient for the stringing process. The string can then be threaded into and pushed up this section with length a. Then handle 82 is withdrawn again in the direction of arrow 102, whereupon tube 14 is pulled out of the hole and off the string. The string is then left threaded through the hole. The device is again ready for use when handle 82 and inserting part 90 have been pushed back again into the nonwithdrawn position shown in FIGS. 11 and 12.

The invention has been described in detail with particular reference to the preferred embodiments thereof, but it should be understood that variations and modifications can be effected within the spirit and scope of our invention as described herein and defined in the appended claims.

I claim:

1. Device for threading strings or the like in a through bore of an anchoring part, frame, or the like, characterized by a handle (10, 80, 82), a tube (14) connected to the handle, the inside diameter of said tube matching the outside diameter of the string (50) to be threaded with play, and by a stylet (12, 56) with a tapered rounded tip (29,58), said stylet being insertable in the tube (14) in such manner that it partially fills the tube and partially projects beyond the forward end (34, 64) of the tube.

2. Device according to claim 1, characterized by the fact that tube (14) is firmly connected to handle (80) and by the fact that stylet (56) is insertable into the tube from the free end (64) of said tube.

3. Device according to claim 1, characterized by the fact that tube (14) is mounted in a through axial bore (30) of an inserting part (16, 90) and projects from the forward end of said part, and by the fact that the inserting part (16, 90) is extractable with handle (10, 82), but is nonrotatably connected thereto with respect to the withdrawal direction.

4. Device according to claim 3, characterized by the fact that stylet (12) is firmly connected to handle (10, 82) and passes through the entire axial bore (30) of the inserting part when said inserting part (16, 90) is in the nonretracted state.

5. Device according to claim 4, characterized by the fact that stylet (12) is screwed interchangeably in handle (10, 82).

6. Device according to claim 1, characterized by the fact that the leading edge (34) of tube (14) is rounded on the outside.

7. Device according to claim 3, characterized by the fact that inserting part (16) is separable by pulling it out of handle (10).

8. Device according to claim 1, characterized by the fact that stylet (56) comprises a shaft (60, 76) insertable in the forward end (64) of tube (14), said shaft merging with tip (58) by a step (62), whereby step (62) abuts the leading edge (64) of tube (14) when in the inserted state, and the outer surfaces of tip (58) and tube (14) merge flush with one another.

9. Device according to claim 8, characterized by the fact that a pin (74, 78) is firmly connected to handle (10, 80), said pin being disposed in tube (14) and corresponding to the diameter of shaft (60, 76), shaft (60, 76) abutting said pin when handle (10, 80), stylet (56), and inserting part (16) are in the assembled state.

10. Device according to claim 9, characterized by the fact that pin (74, 78) is interchangeably screwed in handle (10, 80).

11. Device according to claim 3, characterized by the fact that inserting part (16) comprises axial ribs (24) on its outer surface, said ribs being insertable with play in matching axial recesses (22) in handle (10).

12. Device according to claim 4, characterized by the fact that inserting part (19) is retractable up to a stop (94, 96) from handle (82), whereby stylet (12) fills at least part (a) of the length of the tube when inserting part (90) is withdrawn up to the stop.

13. Device according to claim 12, characterized by the fact that the part (a) of the length of the tube which is filled by stylet (12) when inserting part (90) is in the retracted state is slightly longer than the bore (40) of the anchoring part, frame (42), or the like which accepts string (50).

14. Device according to claim 12, characterized by the fact that inserting part (90) comprises a guide section (88), said section being displaceably fitted into a corresponding recess (86) in handle (82) and being displaceable in the retraction direction of inserting part (90).

15. Device according to claim 14, characterized by the fact that the stop is formed by a pin (96), said pin transversing guide section (88) at right angles to the retraction direction and being guided in at least one lengthwise slot (94), whereby pin (96) is fastened in handle (92) and lengthwise slot (94) is formed in guide section (88) of inserting part (90) or vice versa.

16. Device according to claim 1, characterized by the fact that tube (14) is made of metal and is cast in handle (80) or inserting part (16, 90) made of plastic.

17. Device according to claim 1, characterized by the fact that stylet (12, 56) consists of metal.

18. Device according to claim 9, characterized by the fact that pin (74, 78) is made of metal.

19. Device according to claim 1, characterized by the fact that handle (82) is made in the form of a pistol butt.

* * * * *